US005118912A

United States Patent [19]

Itabashi

[11] Patent Number: 5,118,912

[45] Date of Patent: Jun. 2, 1992

[54] SWITCHING DEVICE

[75] Inventor: Tomoaki Itabashi, Shiki, Japan

[73] Assignee: Asahi Kogaku Kogyo Kabushiki Kaisha, Tokyo, Japan

[21] Appl. No.: 550,616

[22] Filed: Jul. 10, 1990

[30] Foreign Application Priority Data

Jul. 12, 1989 [JP] Japan ..... 1-81832[U]

[51] Int. Cl.[5] ..... H01H 13/14; H01H 1/14

[52] U.S. Cl. ..... 200/534; 200/250; 200/295

[58] Field of Search ..... 200/508, 511, 515, 516, 200/517, 534, 535, 239, 250, 288, 290, 295, 512, 513

[56] References Cited

U.S. PATENT DOCUMENTS

| | | | |
|---|---|---|---|
| 3,982,089 | 11/1974 | Hyltin | 200/512 |
| 4,068,369 | 1/1978 | Kaminski | 200/517 X |
| 4,164,634 | 8/1979 | Gilano | 200/511 X |
| 4,349,712 | 9/1982 | Michalski | 200/517 |
| 4,375,585 | 3/1983 | Lee | 200/5 A |
| 4,445,757 | 5/1984 | Enomoto et al. | 350/429 |
| 4,540,865 | 9/1985 | Calder | 200/513 X |
| 4,659,881 | 4/1987 | Dowe | 200/517 X |
| 4,767,943 | 8/1988 | Alder et al. | 200/512 X |
| 4,771,139 | 9/1988 | DeSmet | 200/512 X |
| 4,918,264 | 4/1990 | Yamamoto et al. | 200/5 R |

FOREIGN PATENT DOCUMENTS

| | | | |
|---|---|---|---|
| 0322514 | 7/1989 | European Pat. Off. | 200/512 |
| 2902769 | 7/1980 | Fed. Rep. of Germany . | |
| 3614873 | 2/1987 | Fed. Rep. of Germany . | |
| 1309710 | 3/1973 | United Kingdom . | |
| 2043349 | 10/1980 | United Kingdom . | |
| 2100517 | 12/1982 | United Kingdom . | |
| 2107523 | 4/1983 | United Kingdom . | |
| 2124031 | 2/1984 | United Kingdom . | |
| 2174844 | 11/1986 | United Kingdom . | |
| 8201100 | 4/1982 | World Int. Prop. O. . | |

OTHER PUBLICATIONS

Johnson, Jr., D. O., Keyboard and Wiping Contact Assembly, IBM Technical Disclosure Bulletin, vol. 13, No. 7, Dec. 1970.

*Primary Examiner*—Henry J. Recla
*Assistant Examiner*—Glenn T. Barrett
*Attorney, Agent, or Firm*—Sandler, Greenblum & Bernstein

[57] ABSTRACT

A switching device having an operation button member to be depressed includes at least one contact member to be moved by the operation button member when the operation button member is depressed. The contact member is electrically conductive and a conductive member for contacting the contact member when the operation button member is depressed by a predetermined amount is provided. An elastic member is arranged opposite to the at least one contact member with respect to the conductive member, so as to be elastically deformed when the operation button member is depressed, after the contact member has contacted the conductive member.

10 Claims, 3 Drawing Sheets

SWITCHING DEVICE

BACKGROUND OF THE INVENTION

The present invention relates to a switching device suitable as a release switch for cameras.

Micro switches and leaf switches using a leaf spring are commonly used as a release switch for cameras. Recently, however, release switches arranged in such a manner that a dome-shaped spring made of a conductive material is fixed on a flexible circuit board as a release contact piece and the conducting portion formed on the flexible circuit board is brought into contact with the dome-shaped release contact piece by a release button to effect release operation have become widely used because their manufacturing cost is inexpensive.

FIG. 1 shows the typical arrangement of such a release switch. In FIG. 1, the release switch arrangement comprises a release button 2 serving as an operation button slidably attached to an upper cover 1, an elastically deformable dome-shaped release contact piece 3, a flexible circuit board 4, a member 5 by which the release contact piece 3 is fixed to the flexible circuit board 4, another contact piece 6 for actuating a light measuring device (not shown) interposed between the release contact piece 3 and the release button 2, a conducting portion 7 formed on the flexible circuit board 4 just below the release contact piece 3, and a mother plate 8 for supporting the flexible circuit board 4. The release button 2 includes a large diameter head portion 21, a small diameter shaft portion 22, and an enlarged diameter contact portion 23 disposed at the extreme end of the shaft portion 22, opposite to the head portion 21. A coil spring 9 surrounding the shaft portion 22 is interposed between the head portion 21 and a recessed surface 11 of the upper cover 1. In addition, a lock washer 24 is attached to the contact portion 23. With this arrangement, the release button 2 is neutrally urged to the outward direction of the upper cover 1 (kept at the position projecting from the upper cover 1) and the stroke of the release button 2 is also kept constant.

In the release switch arranged as described above, when the release button 2 is depressed, first, the contact portion 23 at the extreme end of the release button 2 is brought into contact with the another contact piece 6, and then with the dome-shaped release contact piece 3. When the release button 2 is further depressed, the release contact piece 3 is elastically deformed and brought into contact with the conducting potion 7 on the flexible circuit board 4 disposed just below it, whereby release operation is effected.

The release switch arranged as described above provides a so-called feeling of clicking in the release operation and thus provides a good feeling for the operation.

With the arrangement of the conventional release switch, however, there is a disadvantage as follows: when the release button is completely depressed, the extreme end 23 of the release button 2 is brought into contact while the mother plate 8 with nipping the release contact piece 3. The contact piece 6, and the conducting portion 7 of the flexible circuit board 4 therebetween, which causes a so-called feeling of collision against bottom. Further, since the mother plate is made of a rigid material, camera-shake occurs.

Further, there is a need for a switching device which does not cause the feeling of collision against the bottom in various fields in addition to being used as the release switch for cameras.

SUMMARY OF THE INVENTION

It is therefore an object of the present invention to provide a switching device which basically has the above switch arrangement and causes no feeling of collision against the bottom even if the operation button is completely depressed.

To accomplish the above objects, according to the invention, there is provided an improved switching device having an operation button member to be and including at least one contact member to be moved by the operation button member when the operation button member is depressed, the contact member is electrically conductive.

A conductive member for being contacted with the contact member when the operation button member is depressed by a predetermined amount and an elastic member is arranged opposite the at-least-one contact member with respect to the conductive member for being elastically deformed when the operation button member is depressed after the contact member has been contacted with the conductive member.

DESCRIPTION OF THE ACCOMPANYING DRAWINGS

DESCRIPTION OF THE EMBODIMENTS

Figure 1:
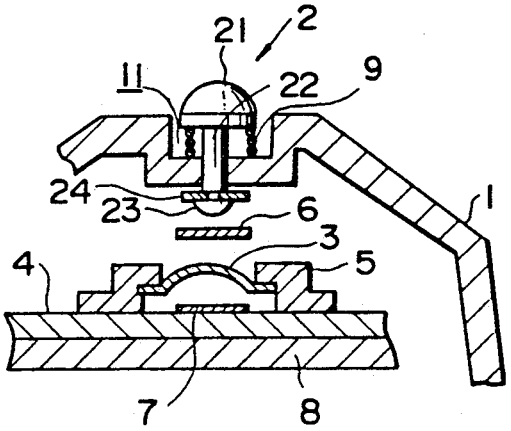
FIG. 1 PRIOR ART
FIG. 1 is a cross sectional view showing a conventional release switch.
Figure 2:
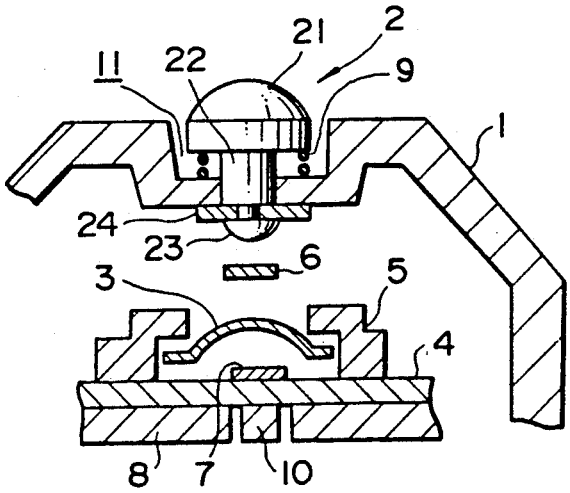
FIG. 2 is a cross sectional view showing a release switch, as an example of a switch device, according to the present invention.

FIG. 2 schematically shows the release switch of a camera as a switch device according to an embodiment of the present invention. Since the release switch of the embodiment has the same basic arrangement as that of the one shown in FIG. 1, the same numerals are used in FIG. 1 and FIG. 2 to denote the same parts.

Similar to the release switch of FIG. 1, the release switch according to the present invention has a basic arrangement comprising a release button 2 slidably attached to an upper cover 1, an elastically deformable dome-shaped release contact piece 3, a flexible circuit board 4, a member 5 by which the release contact piece 3 is fixed to the flexible circuit board 4. Another contact piece 6 for a light measuring device (not shown) is interposed between the release contact piece 3 and release button 2. A conducting portion 7 is formed on the flexible circuit board 4 just below the release contact piece 3, and a mother plate 8 is provided for supporting flexible circuit board 4. The release button 2 includes a large diameter head portion 21, a small diameter shaft portion 22, and an enlarged diameter contact portion 23 disposed at the extreme end of the shaft portion 22 opposite to the head portion 21. A coil spring 9 surrounding the shaft portion 22 is interposed between the head portion 21 and the recessed surface 11 of the upper cover 1. In addition, a lock washer 24 is attached to the contact portion 23. With this arrangement, the release button 2 is neutrally urged in the outward direction of the upper cover 1 by a coil spring 9 (kept at the position projecting from the upper cover 1).

In the release switch arranged as described above, when the release button 2 is depressed, first, the contact portion 23 at the extreme end of the release button 2 is brought into contact with the another contact piece 6, and then with the dome-shaped release contact piece 3. When the release button 2 is further depressed, the release contact piece 3 is elastically deformed and brought into contact with the conducting potion 7 on the flexible circuit board 4 disposed just below it, whereby release operation is effected.

Figure 3:
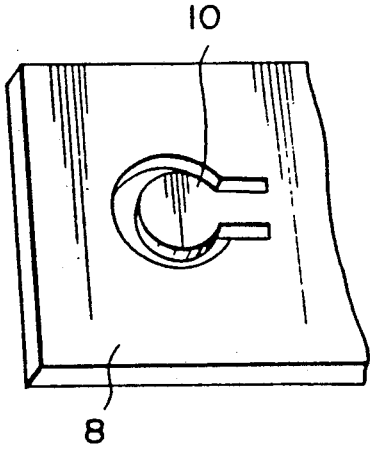
FIG. 3 is a perspective view showing an example of a mother plate of the release switch of FIG. 2.

An elastically deformable receiving portion 10 is defined by a portion of the mother plate 8 located under the conducting portion 7. As shown in FIG. 3, the receiving portion 10 is formed by making slits in the mother plate 8. In the illustrated embodiment, the receiving portion 10 is shaped as a cantilever having a mushroom shape and is elastically deformed when the release button 2 contacts the head thereof through the contact piece 6, the release contact piece 3 and the conducting portion 7 of the flexible circuit board 4. When the release button 2 is returned, the receiving portion 10 can return to its neutral position. The mother plate 8 is preferably made of metal for this purpose.

The operation of the release switch arranged as above will be described with reference to FIGS. 4A through 4C.

Figure 4A:
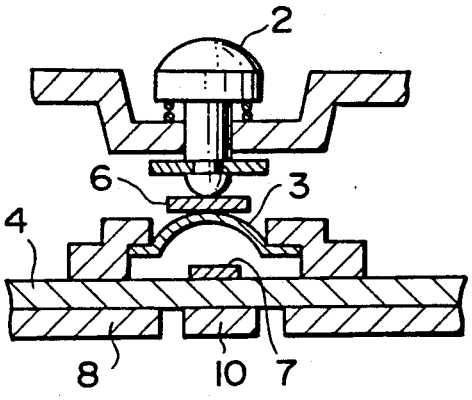
FIGS. 4A through 4C are diagrams showing the operation of the release switch of FIG. 2.

First, in FIG. 4A, when the release button 2 is depressed, the contact piece 6 is brought into contact with the release contact piece 3, which actuates a light measuring device (not shown) to automatically effect photometry and focusing.

Figure 4B:
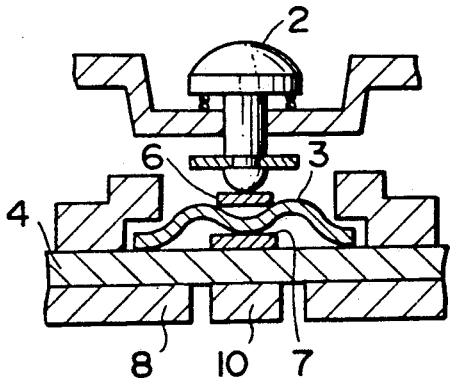

Next, as shown in FIG. 4B, when the release button 2 is further depressed, the dome-shaped release contact piece 3 is elastically deformed, and thus the release contact piece 3 is brought into contact with the conducting portion 7 on the flexible circuit board 4, whereby the release operation is effected.

Figure 4C:
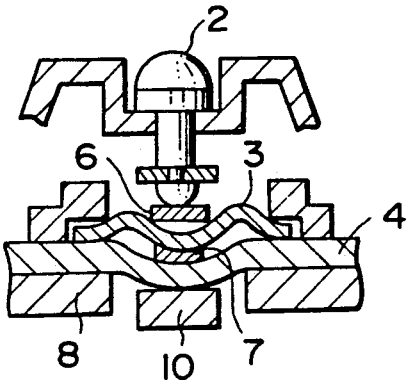

Further, as shown in FIG. 4C, when the release button 2 is completely depressed, the dome-shaped release contact piece 3 is further deformed, the conducting portion 7 on the flexible circuit board 4 is also deformed, and the receiving portion 10 of the mother plate 8 is deformed accordingly.

When the release button 2 has completed all the strokes (when it is at the marginal portion of the stroke), no feeling of collision against the bottom is caused. As a result, even if the release button 2 is completely depressed, the camera is not moved by the collision of the release button 2 against the rigid mother plate 8. Further, when an external force is removed from the receiving portion 10, it returns to its neutral position by the spring force thereof, thus the processes shown in FIGS. 4A through 4C can be repeated as many times as desired.

Figure 5:
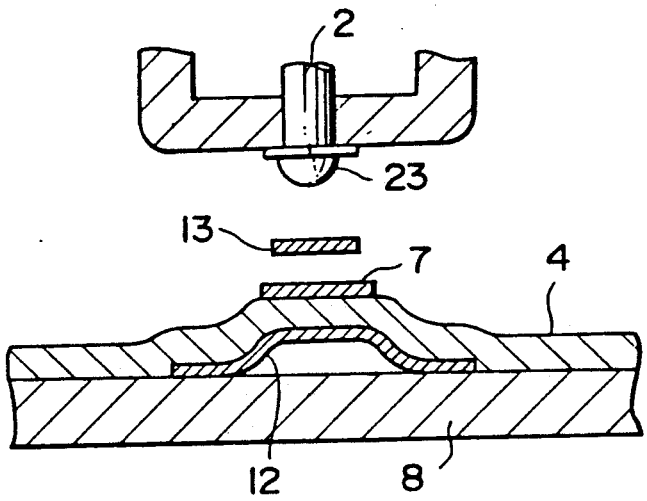
FIG. 5 is a cross sectional view of a release switch as another embodiment of the switch device according to the present invention.

FIG. 5 shows a release switch of another embodiment of a switching device according to the present invention. In this release switch, an elastic member 12 formed of a dome-shaped spring or the like and is disposed between the mother plate 8 and a flexible circuit board 4. A conducting portion 7 is formed on the flexible circuit board 4 just above the elastic member 12 and a release contact piece 13 is disposed thereabove.

With this arrangement, the release switch is operated as follows.

Figure 6:
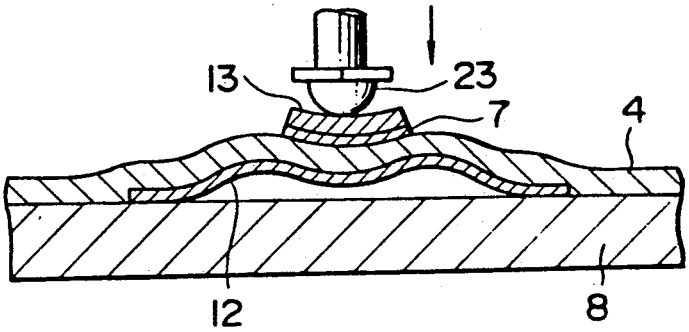
FIG. 6 is a cross sectional view showing the operation of the release switch of FIG. 5.

When an operation button (release button) 2 is depressed, the enlarged diameter contact portion 23 at the extreme end of the button 2 is brought into contact with the release contact piece 13 and shifts it downwardly so that it comes into contact with the conducting portion 7. When the button 2 is further depressed, the elastic member 12 is deformed, as shown in FIG. 6. Since the stroke of the release button 2 is to be set such that the depressed portion of the elastic member 12 is not held in abutment against the mother plate 8 even if the release button 2 is completely depressed, the stroke of the release button is finished before the elastic member 12 is brought into contact with the mother plate 8. As a result, no feeling of collision against bottom is caused in the release button 2.

Although the switching device according to the present invention is described as the release switch used for cameras in the above embodiments, the present invention is not limited thereto, but applicable to various switching devices in which the prevention of the feeling of collision against a bottom is desired.

As described above, according to the switching device of the present invention, the elastic receiving portion is provided with the mother plate, and thus even if the operation button is completely depressed, no feeling of collision against bottom is caused as the receiving portion is accordingly deformed. Therefore, when the switch device is used as the release switch of a camera, the camera is not moved during photographing. Further, the switch device having the basic arrangement as described above has a further feature in that the number of parts and assemble steps are reduced.

What is claimed is:

1. A switching device having an operation button member mounted to be depressed, said switching device comprising:

at least one contact member mounted for movement by said operation button member when said operation button member is depressed, said at least one contact member being electrically conductive;

a conductive member for contacting said at least one contact member when said operation button member is depressed by a predetermined amount; and an elastic member arranged opposite said at-least-one contact member with respect to said conductive member, and spaced from said conductive member, to be elastically deformed when said operation button member is depressed after said contact member has contacted said conductive member.

2. The switching device according to claim 1, said elastic member comprising a plate having a displaceable free end.

3. The switching device according to claim 1, wherein said conductive member comprises a printed portion of a flexible circuit board.

4. The switching device according to claim 1, wherein said at-least-one contact member comprises a dome-shaped contact member adapted to contact said conductive member, said dome-shaped contact member being elastically deformed when depressed.

5. The switching device according to claim 4, wherein said at-least-one contact member further comprises another contact member shiftably arranged between said operation button member and said dome-shaped contact member, said another contact member positioned to be depressed by said operation button member to contact said dome-shaped contact member.

6. The switching device according to claim 4, wherein said elastic member comprises a dome-shaped elastic member positioned opposite to said at-least-one contact member with respect to said conductive member, said elastic member mounted on a base plate.

7. A switching device having an operation button member mounted to be depressed, said switching device comprising:

at least one contact member mounted for movement by said operation button member when said operation button member is depressed, said at least one contact member being electrically conductive;

a conductive member for contacting said at least one contact member when said operation button member is depressed by a predetermined amount;

an elastic member arranged opposite to said at least one contact member with respect to said conductive member to be elastically deformed when said operation button member is depressed after said contact member has contacted said conductive member;

said at least on contact member comprising a dome shaped contact member adapted to be contacted with said conductive member, said dome-shaped contact member being elastically deformed when depressed; and said elastic member comprising a plate member, a surface of said plate member extending orthogonal to the direction in which said conductive member is depressed, one end of said plate member is fixed and the other end is movable.

8. A switching device having an operation button member mounted to be depressed, said switching device comprising:

at least on contact member mounted for movement by said operation button member when said operation button member is depressed, said at least one contact member being electrically conductive;

a conductive member for contacting said at least one contact member when said operation button member is depressed by a predetermined amount;

an elastic member arranged opposite to said at least one contact member with respect to said conductive member to be elastically deformed when said operation button member is depressed after said contact member has contacted said conductive member;

said at least on contact member comprising a dome-shaped contact member adapted to be contacted with said conductive member, said dome shaped contact member being elastically deformed when depressed;

said at least one contact member further comprising another contact member shiftably arranged between said operation button member and said dome-shaped contact member, said another contact member positioned to be depressed by said operation button member to contact said dome shaped contact member; and said elastic member comprising a plate member, a surface of said plate member extending orthogonal to the direction in which said conductive member is depressed, one end of said plate member is fixed and the other end is movable.

9. A switching device comprising:

at least one contact member mounted for movement, said at least on contact member being electrically conductive;

a conductive member for contacting said at least one contact member when said at least one contact member is moved by a predetermined amount; and an elastic member, arranged opposite to said at least one contact member with respect to said conductive member and spaced from said conductive member, said elastic member adapted to be elastically deformed when said contact member has contacted said conductive member.

10. A switching device according to claim 9, wherein said elastic member comprises a plate having a displaceable free end.

* * * * *